US010590665B2

(12) United States Patent
Lenkin

(10) Patent No.: US 10,590,665 B2
(45) Date of Patent: Mar. 17, 2020

(54) ADJUSTABLE SUPPORT DEVICE AND SHORING SYSTEM

(71) Applicant: Michael L. Lenkin, Bethesda, MD (US)

(72) Inventor: Michael L. Lenkin, Bethesda, MD (US)

( * ) Notice: Subject to any disclaimer, the term of this patent is extended or adjusted under 35 U.S.C. 154(b) by 3 days.

(21) Appl. No.: 16/050,783

(22) Filed: Jul. 31, 2018

(65) Prior Publication Data

US 2018/0334818 A1 Nov. 22, 2018

Related U.S. Application Data

(62) Division of application No. 15/707,489, filed on Sep. 18, 2017, now Pat. No. 10,053,877.

(60) Provisional application No. 62/396,296, filed on Sep. 19, 2016.

(51) Int. Cl.
*E04G 11/48* (2006.01)
*E04G 11/38* (2006.01)
*E04G 11/50* (2006.01)

(52) U.S. Cl.
CPC ..... *E04G 11/486* (2013.01); *E04G 11/483* (2013.01); *E04G 11/50* (2013.01); *E04G 11/38* (2013.01)

(58) Field of Classification Search
CPC ..... E04G 11/38; E04G 11/40; E04G 11/48; E04G 11/483; E04G 11/486; E04G 11/50
USPC ..... 264/31; 249/18, 26, 28
See application file for complete search history.

(56) References Cited

U.S. PATENT DOCUMENTS 4,113,219 A * 9/1978 Mieyal ..... E04F 15/02447 254/104
4,123,032 A * 10/1978 Teschner ..... E04G 11/40 249/18
4,147,321 A * 4/1979 Gostling ..... E04G 11/486 248/354.1
4,752,057 A * 6/1988 Hagemes ..... E04G 11/483 248/354.5
2016/0060882 A1* 3/2016 Bond ..... E04G 11/38 264/34

FOREIGN PATENT DOCUMENTS

GB 2099902 A * 12/1982 ..... E04G 11/486

* cited by examiner

*Primary Examiner* — Michael Safavi

(57) ABSTRACT

A shoring system for concrete slabs is disclosed. One such system includes a drop head with a beam support member which can be moved between lower and upper positions, and a wedge member which locks the beam support member in its upper position by a translational, sliding movement thereof. Wedge member includes a narrower toe portion and a wider heel portion, and the toe portion is insertable past corresponding engagement surfaces on the post of the drop head, to support the wedge member in its upper position. The beam support member has a lower surface engaged by the wedge member and such lower surface is longitudinally spaced from the upper surface of the beam support member, so that there is open space between the wedge member and the bottom surfaces of beam supported by the upper surface of the beam support member.

5 Claims, 10 Drawing Sheets

ADJUSTABLE SUPPORT DEVICE AND SHORING SYSTEM

CROSS-REFERENCE TO RELATED APPLICATIONS

This application is a divisional application of U.S. patent application Ser. No. 15/707,489, filed Sep. 18, 2017, which in turn claims benefit to U.S. Provisional Appl. No. 62/396,296, filed on Sep. 19, 2016, the contents of which are hereby incorporated by reference in their entirety.

STATEMENT REGARDING FEDERALLY SPONSORED RESEARCH AND DEVELOPMENT

This invention was made without federal government support.

BACKGROUND OF THE INVENTION

Shoring is the process of supporting a building or structure with shores (props) during construction, such as building, repairs or alterations. It is common practice in the construction industry to shore concrete slabs with a temporary support frame. For large slabs, such as those forming building floor structures, a number of shoring frames must be used. Generally, the support frames remain in place until the slab has cured sufficiently to allow the safe removal of the frame(s).

The present disclosure relates to a support device and shoring system designed to support formwork for concrete construction, and allow the formwork members to be removed when the concrete has obtained sufficient strength, without allowing the new concrete to move.

Devices of the prior art suffer from various drawbacks and disadvantages. For example, certain devices of the prior art use a rotating wedge nut. The location of the wedge nut is generally disadvantageously near, or in the same plane as, the members that it is supporting. This creates a condition that, when a hammer is swung to loosen the nut, it has to be done in a confined space without contacting the other formwork members. In addition, since the wedge nut requires a rotating motion, the location that the tradesperson is trying to hit with a hammer is constantly changing in location.

BRIEF SUMMARY OF THE INVENTION

In one exemplary embodiment, an adjustable support device and adjustable shoring system comprise a compression/face plate affixed to the head of a post body, a height-adjustable beam support member comprising a beam plate with a pair of primary tabs and secondary tabs for engaging and supporting beams (of steel or other material), and a slidable locking wedge for securing the beam support member at the appropriate position along the post body.

The device may be a drop head, which drop head is securable to a post or so-called post shore. The drop heads and associated post shores, in turn, may comprise part of a larger framework of floor slab formwork. The device is assembled prior to concreting, meaning it is positioned with the beam support member in proper position beneath the face plate, and held securely in position by engaging the slidable locking wedge in a secure position beneath the beam support member, thereby securing the beam support member in the "assembled" position. A main beam attaches to the assembled device; secondary beams may also be attached to the device or to the main beam, thereby forming a beam framework interconnected with additional devices. The result is a load bearing lattice. Following concreting, the slidable locking wedge is disengaged (such as by use with a hammer along a protruding edge of the slidable locking wedge, thereby releasing the wedge from the locked position along the device body). The beam support member is then released and drops along the length of the device body, bringing the beams down away from the concrete floor slab.

The device is compatible with slab forming systems comprising beams and props (shores) of varying lengths, such as those shores known in the art.

Primary and secondary beams may be of varying lengths, generally of lengths suitable for construction. Overall system capacity is dependent on the arrangement of the post (temporary column that apparatus is bolted to); length of posts; apparatus; main beam (getter); and secondary beam Goist).

In one embodiment, props (post shores) are assembled to the appropriate height for the formwork to be installed, accounting for the height of the device. The device is then fixed to the head of the prop, such as by bolts, screws, or other appropriate attachment means as may be known in the art. The device is assembled into the locked position by raising the beam support member upward along the body of the device, until the beam support member connects with the positioning member near the head of the device. The resulting space between the beam support member and the face plate is of sufficient width, height and depth to engage the end of a beam. The beam support member is secured in position along the body of the device by the slidable locking wedge. The slidable locking wedge is raised along the body of the device and secured in position beneath the beam support member. The overall load capacity of the device ranges depending on the beams and the shoring system, but in certain implementations, the system is designed to withstand a load capacity up to 229.25 kN.

According to another possible embodiment, the device comprises a drop head, which may be used in a system for shoring concrete flooring or slabs, along with a plurality of removable beams securable to the drop head. The drop head in one variation has at least one projection extending transversely from the perimeter wall of the post of the drop head. The drop head is equipped with a beam support member which has an upper surface adapted to support an end of at least one of the beams of a system. An aperture in the beam support member is sized so that the beam support member can be longitudinally moved between upper and lower positions relative to the post of the drop head. The drop head further includes a wedge member having a slot defined therein. The slot is also dimensioned so that it can be longitudinally movable along the post.

In this embodiment, the beam support member is located above the wedge member, and the top surface of the wedge member engages the lower surface of the beam support member when the wedge member is moved longitudinally towards the upper portion of the post. The slot of the wedge member has an inner wall configured to engage a projection of the post of the drop head when the wedge member and beam support member are advanced to the upper position, and the wedge member is slid transversely relative to the post.

In still another embodiment, the wedge member described above includes at least one pair of surfaces which extend from a heel portion at an angle to terminate in a toe portion of lesser dimension than the heel portion. In this way, a wedge is formed by the pair of surfaces. The wedge member is oriented and secured to the post so that the toe is oriented toward the projection of the post, and slightly above a top engagement surface of the projection. When the bottom surface of the beam support member is located above this engagement surface, the beam support member is raised to its upper position. In this manner, the toe portion is insertable between the projection on the post and the bottom surface of the beam support member when the wedge member is in the upper position of the post and slid transversely.

In still other embodiments, the drop head is part of a shoring system for concrete slabs in which there are a plurality of drop heads. In still further variations, the shoring system includes a plurality of temporary beams having ends removably secured to one or more of the drop heads in the system. The beams may include primary beams with flanges thereon, the flanges extending longitudinally along the beams. The flanges, in turn, may readily engage corresponding ends of secondary beams therein. The secondary beams, according to certain implementations, may comprise joists and may include end attachment sections with nose portions on the lower surfaces, the noses receivable within flanges of primary beams or stringers.

The foregoing and other aspects, features, details, utilities, and advantages of the present disclosure will be apparent, in addition, by the accompanying drawings of illustrated embodiments.

DETAILED DESCRIPTION OF THE INVENTION

Figure 1A:
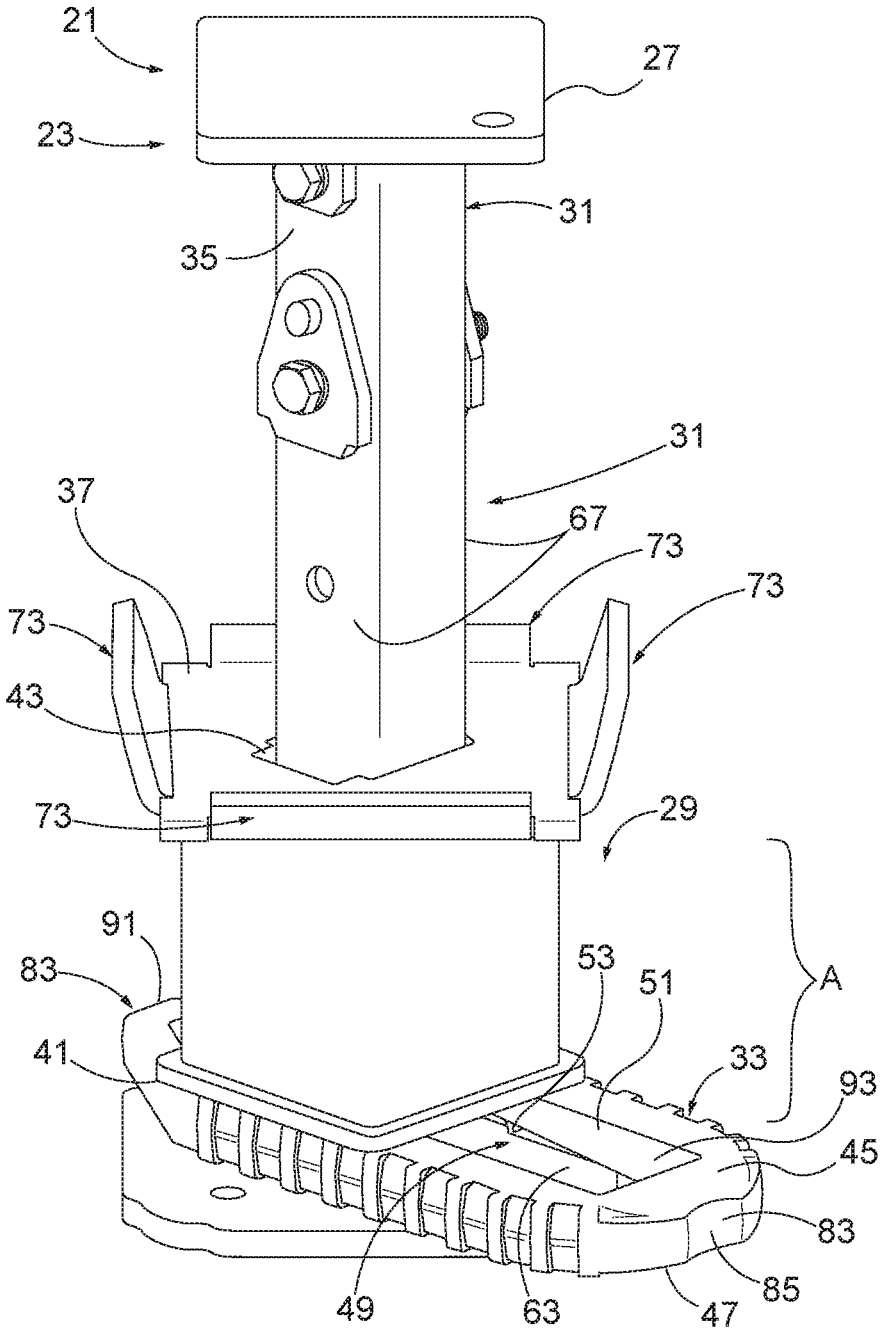
FIGS. 1A and 1B are isometric views of one exemplary embodiment of a device according to the present disclosure.
Figure 1B:
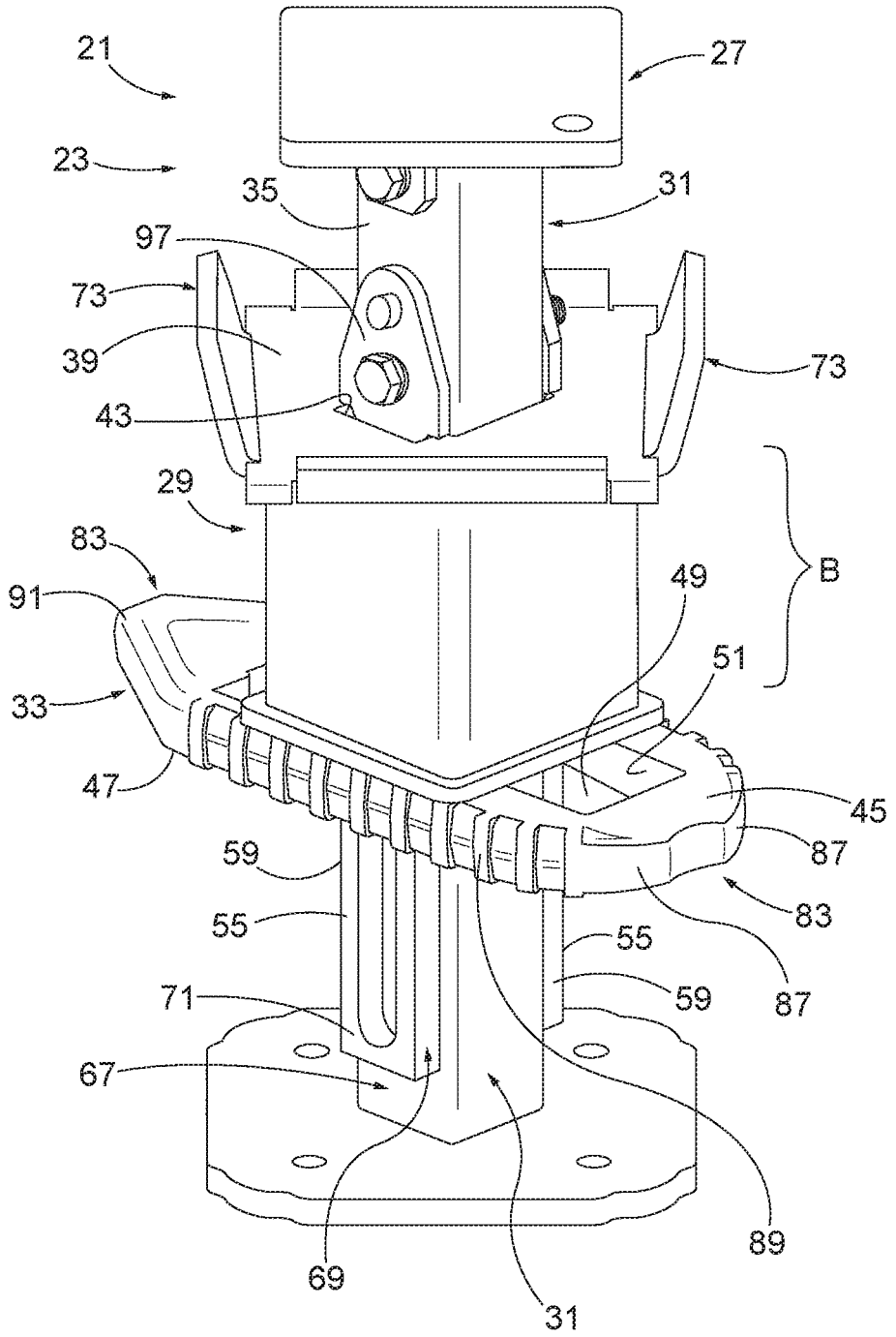

Referring now to the drawings, and in particular to FIGS. 1A and 1B, a device 21 for use in a system for shoring concrete flooring or slabs comprises a drop head 23 which is securable to a post shore 25 for use in forming temporary support or shoring frames in the construction of concrete flooring or slabs. The drop head 23 includes a compression plate or face plate 27 with an upper surface for opposing or engaging the underside of concrete flooring or framework for supporting concrete flooring. As explained subsequently with reference to FIGS. 4A and 4B, device 21, including drop head 23, include features which temporarily secure one or more beams so that the beam top surfaces are generally co-planar to compression plate or face plate 27, thereby forming a lattice or framework for supporting overlying concrete slab or flooring. One of the steps involved in deploying the supporting framework or plurality of beams to support concrete slab formation is to interconnect the beams between devices 21, and to have such interconnections be straightforward in assembly and disassembly.

To that end, device 21 includes drop head 23 with a longitudinally movable or displaceable set of members. In particular, according to one possible embodiment, beam support member 29 is secured so as to be longitudinally slidable relative to post 31. Slidably secured below beam support member 29 is wedge member 33. Wedge 33 and beam support member 29 are configured to be movable longitudinally between a lower position A, as shown in FIG. 1A to an upper position B, as shown in FIG. 1B.

Post 31 has a perimeter wall 35, having a generally quadrilateral or square cross-section in this particular embodiment, the perimeter wall extending longitudinally between lower and upper portions of the post, the lower and upper portions of the post corresponding, in turn, to the lower and upper positions A, B which wedge member 33 and beam support member 29 can assume.

Figure 4A:
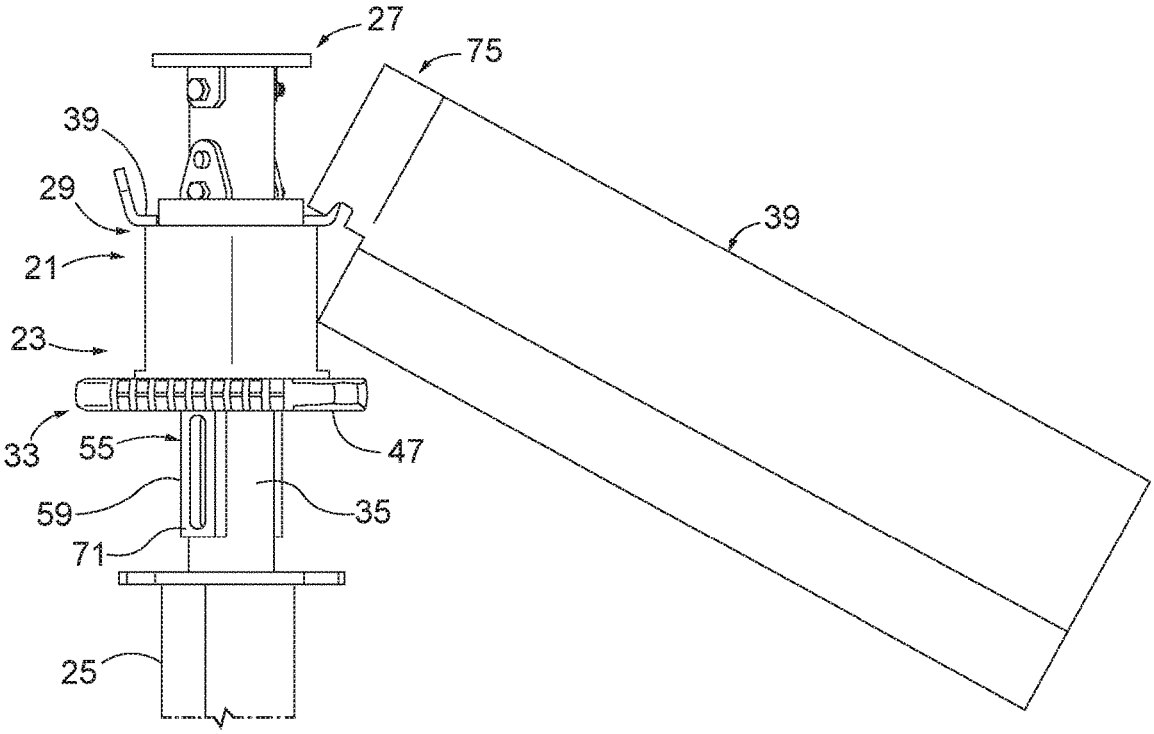
FIGS. 4A and 4B are side elevational views of a system of drop heads and beams according to the present disclosure.
Figure 4B:
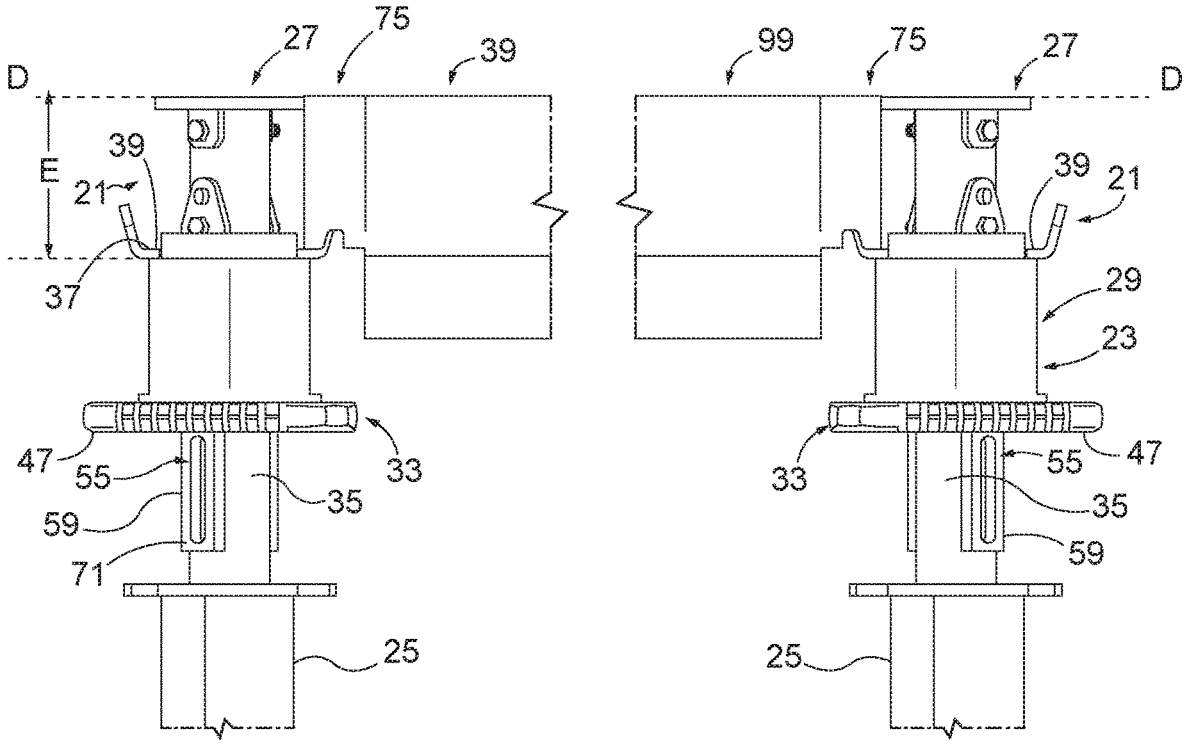

The beam support member has an upper surface 37 adapted to support an end of at least one beam 39 (FIGS. 4A and 4B). The beam support member 29 has a lower surface 41 opposite upper surface 37, and an aperture 43 extends between upper and lower surfaces 37, 41. Surfaces 37, 41 are vertically spaced from each other by an amount sufficient to create between 1 to 6 inches of vertical space or separation between the bottom surfaces of beams 39 engaged at upper surface 37, and wedge member 33 engaged at lower surface 41.

Wedge member 33 has opposing top and bottom surfaces 45, 47, and a slot 49 formed therein and extending longitudinally between the top and bottom surfaces 45, 47.

Beam support member 29 and wedge member 33 are secured to post 31 through aperture 43, in the case of beam support member 29, and slot 49, in the case of wedge member 33. Aperture 43 and slot 49 are sized relative to perimeter wall 35 so as to be manually movable in a longitudinal direction between the lower and upper positions A, B, as discussed previously.

When wedge member 33 is moved longitudinally toward upper portions of post 31, the top surface 45 of wedge member 33 engages lower surface 41 of beam support member 29.

Figure 2:
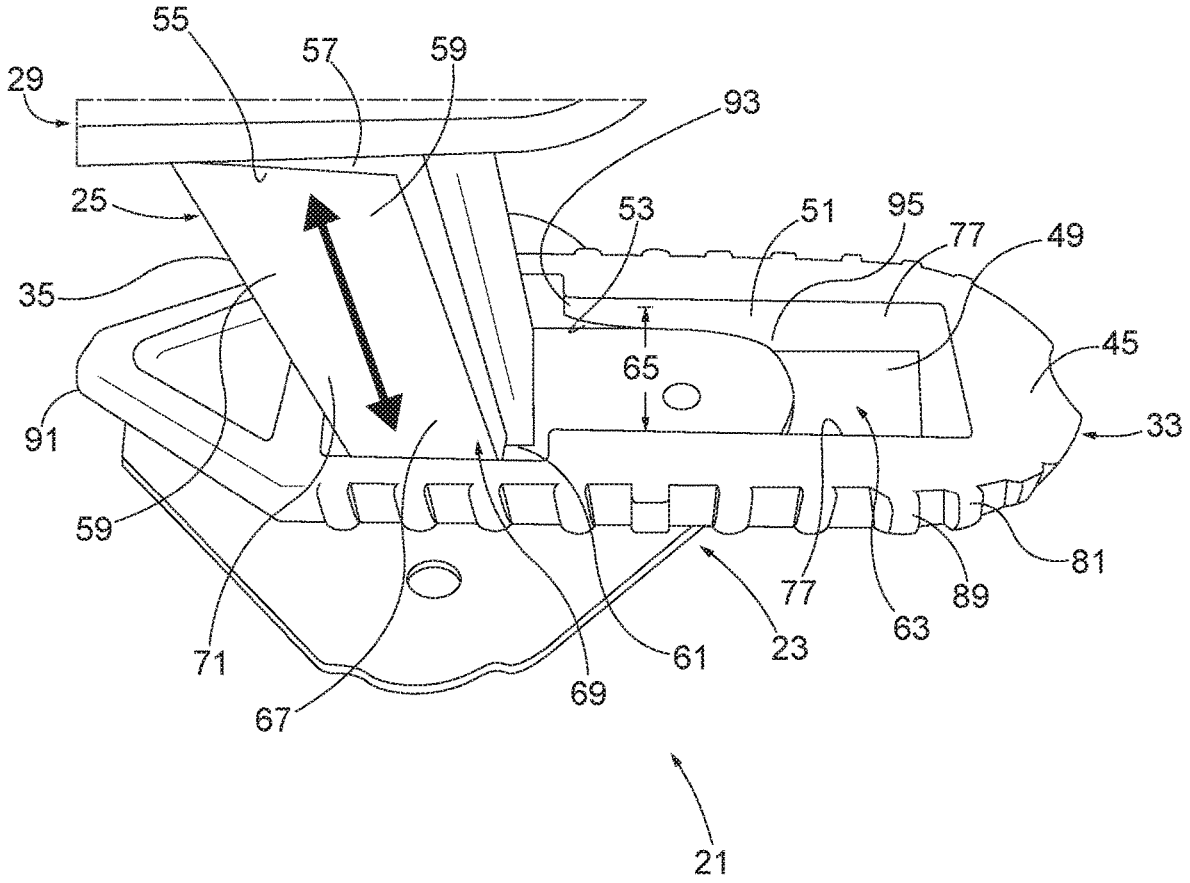
FIG. 2 is an alternative view of a portion of the device shown in FIGS. 1A and 1B.
Figure 3:
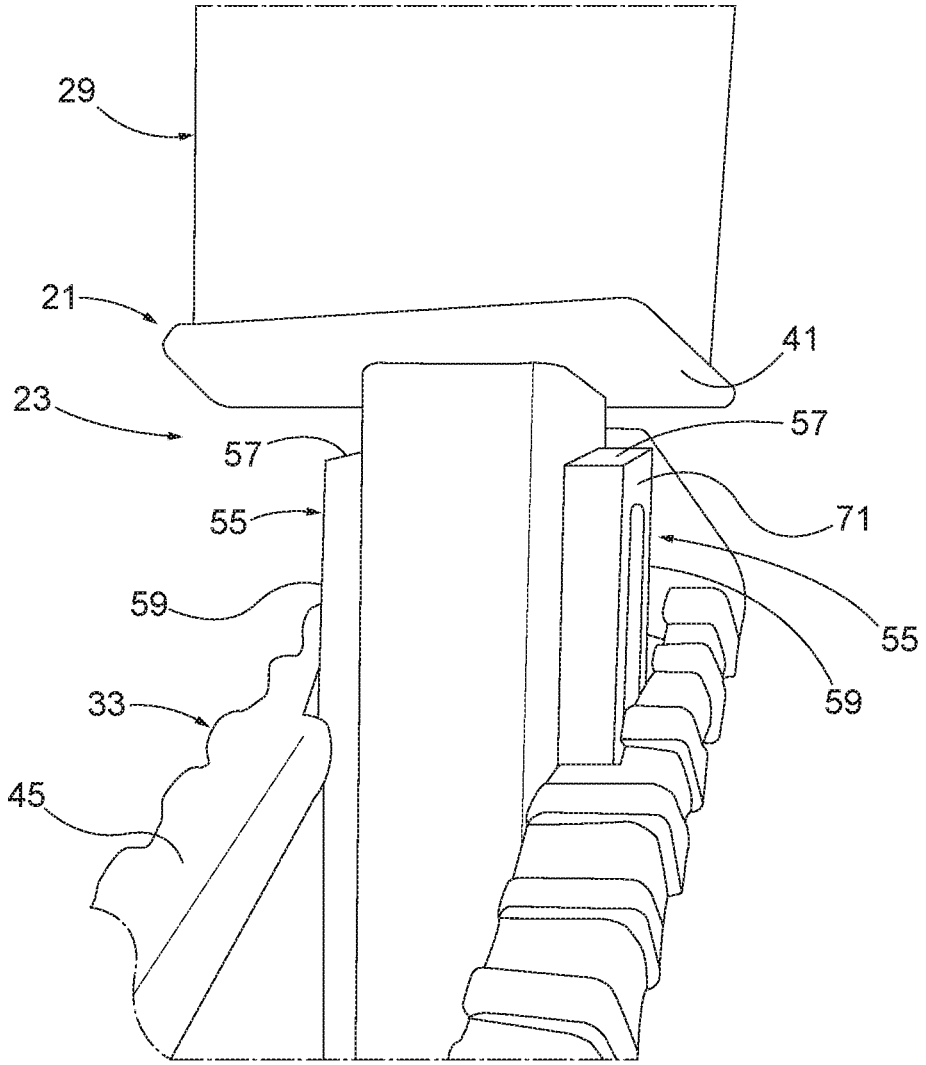
FIG. 3 is another view of the embodiment shown in FIGS. 1A, 1B and 2.

Wedge member 33 is configured with certain features to allow it to be slid linearly and transversely relative to beam support member 29 and post 31, and furthermore, to position and temporarily lock beam support member 29 in a predetermined longitudinal position relative to compression plate 27. This locked longitudinal position is suitable for receiving beams 39 on beam support member 29 at heights to form the required support structure for shoring concrete flooring or slabs. More specifically, slot 49 includes inner wall 51, and such inner wall 51 further includes portions defining a flange 53. Post 31 further includes a projection 55 extending transversely from perimeter wall 35. As best seen in FIG. 2, projection 55 and flange 53 are located and oriented relative to each other so that, when members 29, 33 are in their upper position, as shown in FIG. 1B and FIG. 3, projection 55 and flange 53 cooperate with each other to secure wedge member 33 and beam support member 29 in such upper position B upon sliding wedge member 33 linearly and transversely from an unlocked position, shown generally in FIG. 2 to a locked position shown in FIGS. 1B and 3. In other words, wedge member 33 is slidable transversely by virtue of a suitably dimensioned slot 49, between an unlocked, first transverse position as shown in FIGS. 1A and 2, to a second transverse position, as shown in FIGS. 1B and 3. In one possible implementation, the second locked position may be made available only when members 29, 33 are in upper position B, and locking or transverse movement of wedge member 33 may be confined or limited when in the lower position A. When locked in position B, drop head 23 is positioned relative to compression plate 27 enabling it to receive beams 39 thereon at appropriate heights for further construction of concrete slabbing.

In this embodiment, slot 49 is dimensioned so that wedge member 33 cannot be slid toward the second, transverse position in the direction C, shown in FIG. 3, when wedge member 33 is below its upper position. To that end, projection 55 may be in the form of two (2) projections on opposite sides of perimeter wall 35, and each projection has a corresponding shoulder 59 with an upper engagement surface 57. When wedge member 33 is moved upwardly by a sufficient amount to have flange 53 clear engagement surface 57. Wedge member 33 is then able to be slid transversely in the direction of arrow C to remain in the upper position and to maintain overlying beam support member 29 in such upper position as well.

In the embodiment illustrated in FIGS. 1-4 herein, slot 49 is configured to have a first slot area 61 having a first width, and a second slot area 63 having a second width, the slot areas 61, 63 having corresponding dimensions. The second width 65 is defined by the opposing walls of the inwardly extending flanges 53.

Post 31, in turn, has a pair of opposite post sidewalls 67 defining a post width. Each of the sidewalls 67 have the shoulders 59 disposed thereon. The shoulders have corresponding basis 69 located in the lower portion of post 31 and extending towards the upper portion of the post to terminate in the upwardly oriented engagement surface 57 of shoulders 59. Shoulders 59 extend transversely to define longitudinally oriented, planar, outer shoulder surfaces 71, and such outer shoulder surfaces 71 are separated transversely from each other by a corresponding shoulder width.

The above-described dimensions of the post 31 and shoulders 59, on the one hand, relative to the first and second widths of first and second slot areas 61 and 63, on the other hand, are selected to permit transverse sliding of wedge member 33 relative to post 31 when in upper position B, and to inhibit such transverse sliding when in lower position A. The dimensions of first slot area 61 are selected to receive post 31 therein, so that wedge member 33 is longitudinally slidable relative to post 31. The dimensions of the second slot area 63 are selected to be less than the spacing between outer shoulder surfaces 71 thereby prevents transverse sliding of wedge member 33 in the direction of arrow C to the second transverse position when wedge member 33 is disposed in the lower portion of the post. The width of second slot area 63, however, is selected to be greater than the width of post 31 above shoulders 59 and thereby permits transverse sliding of wedge member 33 in the direction C to the second transverse position, to lock the wedge member 33 and over lying beam support member 29 when wedge member 33 is disposed in the upper portion of post 31. When wedge member 33 is slid to the second transverse position as shown in FIGS. 1B and 3, flanges 53 engage corresponding engagement services 57 to lock beam support member 29 relative to post 31. Conversely, when wedge member 33 is located in upper position B but is urged from its locking position transversely in the opposite direction of C, flange portions 33 no longer oppose corresponding engagement surfaces 57, which in turn unlocks beam support member and renders both wedge member 33 and beam support 29 longitudinally slidable relative to post 31.

Upper surface 37 of beam support member 29 includes four (4) tabs 73 disposed to receive corresponding beam ends 75 of beams 39 (FIG. 4A, 4B) at substantially 90° to each other. Tabs 73 are oriented so that they are offset from the quadrilateral sidewalls of perimeter wall 35 by 45°. Inner wall 51 of slot 49, in turn, includes two opposite sidewalls terminating at opposite ends of wedge member 33. Opposite sidewalls 77 oppose opposite sidewalls of post 31. Accordingly, opposite ends 79 of wedge member 33 are oriented at 45° relative to adjacent ones of beams 39 received in corresponding tabs 73 oriented at 90° relative to each other. In this way, opposite ends 79 of wedge 33 extend outwardly from post 31 at radial locations which are 450 from beams 39 extending from post 31, rendering opposite ends 79 of wedge member 33 accessible with less encumbrance from beams 39.

Referring now again to beam support member 29, upper and lower surfaces 37, 41 of beam support member 29 are spaced from each other, in one possible implementation of this disclosure, by a longitudinal distance which is greater than or equal to height of one or more possible temporary beams 39 to be received on upper surface 37 of beam support member 29. In this way, wedge member 33, when engaging lower surface 41 of beam support 29, is substantially located at a height below the lower or lowermost portions of beam 39 when it is received in beam support member 29. By dimensioning beam support member 29 in this manner, wedge member 33 is thus accessible from below beams 39 with less possibility of interference from beam portions blocking access to wedge member 33 or otherwise narrowing such access. Still further, by locating wedge member 33 in a longitudinal plane below the lowermost portions of beams 39, one can more readily access wedge member 33 to manipulate it as required during assembly or disassembly of the shoring system, whether moving wedge member 33 longitudinally upwardly or downwardly, or unlocking or locking it by sliding it transversely when in its upper position B shown in FIG. 1B.

Accessibility of wedge member 33 is further enhanced in the illustrated embodiment by having outer wall 81 of wedge member 33 extend beyond the outer perimeter of beam support member 29, with certain portions of the outer wall 81 extending beyond such perimeter regardless of where wedge member 33 is positioned transversely relative to beam support member 29. Thus, for example, wedge member 33 may have a portion of outer wall 81 at one of its ends extending beyond the outer perimeter of beam support member 29 when wedge member 33 is in the first, unlocked transverse position and may have another portion of outer wall 81 extending beyond beam support member 29 when wedge member 33 is in the second, locked transverse position relative to beam support member 29. In this way, one of the two opposite ends of wedge member 33 is readily accessible as extending beyond the perimeter of beam support member 29 both in the locked and unlocked position, and whether in the lower portion of post 31 or when locked in the upper portion thereof. The opposite wedge ends 83 may be configured to facilitate assembly and disassembly of drop head 23. Thus, in this implementation, one of the wedge ends 83 include a notch 85 sized to receive a hammer strike and thereby define a strike zone to allow the user to hammer in a transverse direction to lock the wedge member 33 in its upper position in FIG. 1B. In the illustrated implementation, flattened surface is likewise provided at the opposite wedge end and is likewise suitable for hammer strike in unlocking the wedge 33 when receiving a hammer blow in the transverse direction thereon. The outer wall 81 of wedge member 33 may likewise be configured with rounded portions sized to be manually graspable, such as at rounded portions 87. In one possible variation, one of the wedge ends 83 includes an apex 91, and the strike surface is located on such apex 91. Wedge member 33 may likewise include ribs 89 to facilitate either manual engagement of wedge member 33 or provide additional strike points for tools associated with movement of wedge member 33.

Referring further to slot 49 formed in wedge member 33, inner wall 51 of slot 49 and flange 53 formed in such inner wall 51 may likewise be configured to have flanges 53 sloped at a positive angle from a heel portion 95 toward one end of wedge member 33 to terminate in a toe portion 93 toward the other end of wedge member 33, the sloping surfaces of flanges 53 forming a wedge with the smaller nose portion of the wedge of lesser height at the toe and the larger heel of the wedge being at the heel portion of wedge member 33. In this way, when wedge member 33 is secured to post 31, it may be secured in such a manner to orient the resulting wedge with toe portion 93 toward projection 55 on post 31. The toe is therefore the first portion of flanges 53 to be inserted between the engagement surface 57 of shoulders 59 and bottom surface of beam support member 29, when in the upper position B shown in FIG. 1B. The configuration of flanges 53 to include corresponding wedges with narrower toes and larger heels facilitates the transverse sliding of wedge member 33 relative to post 31 and engagement surfaces 57 formed thereon.

Devices 21, including drop heads 23 may be utilized as part of a shoring system for concrete slabs, and an exemplary portion of such system is shown in FIGS. 4A and 4B. Multiple drop heads 23 are secured to shore posts 25 and are installed vertically at spaced locations relative to a floor to be shored. Multiple beams 39, schematically shown in FIGS. 4A and 4B, are temporarily and removably secured to corresponding drop heads at corresponding ends 75 of such beams.

The operation of the device 21 according to the present disclosure is readily appreciated from the foregoing description. In one possible implementation method, shoring or reshoring of concrete which is being laid for a given structure involves positioning compression plate 27 at a vertical height relative to a horizontal plane so that plate 27 is capable of supporting part of the load of the support frame for the concrete or the concrete itself. Before or after such positioning, beam support member 29 located below plate 27 may be raised from its first lower position shown in FIG. 1A to a second upper position shown in FIG. 1B.

In the illustrated embodiment, beam support member 29 may be moved vertically upwardly relative to post 31 until such time as it encounters a stopped member 97. The amount that beam support member 29 is lifted upwardly relative to plate 27 may be predetermined, as in the case of using stopped member 97, and may create a vertical distance E, shown in FIG. 4A between upper surface 37 of beam support member 29 and the upper surface of compression plate 27. The vertical distance E, in turn, may be selected to correspond to the anticipated height or distance between the lower surface of beam 39 and upper surfaces 99 of beams 39. In this way, as best seen in FIG. 4B, the planar surface of compression plate 27 and the upper surfaces 99 of beam 39 are substantially co-planar with reference plane D (FIG. 4B), to create a substantially planar supporting surface for overlying concrete flooring or associated framework.

After beam support member 29 has been suitably raised to its upper position, its longitudinal position in such upper location is fixed by imparting horizontal translational (non-rotational) movement to wedge member 33 so as to translate wedge member 33 from a first transverse position, as shown in FIGS. 1A and 2 to a second locked transverse position shown in FIG. 1B, as well as FIGS. 4A and 4B.

During the foregoing steps, or after fixing beams support member 33 in its upper position, beams 39 are deployed so that ends 75 are removably secured relative to device 21 and, more particularly, by having suitable portions of beam 39 engage upper surface 37, and still more particularly, having the ends 75 of the beams removably engage tabs 73 on such upper surfaces 37 of beam support member 29.

The shoring system likewise involves advantageous disassembly methods, as apparent from the foregoing description. Thus, in one possible implementation, after laying the concrete or other flooring associated with the shoring system illustrated in FIGS. 4A and 4B, the longitudinal position of beam support member 29 may be lowered or dropped, either in conjunction with removable beam 39 or before or after such removal. The beam support member 29 is preferably dropped from its upper position shown in FIGS. 4A and 4B to its lower position shown in FIG. 1A. To accomplish such dropping, horizontal translational, non-rotational movement is imparted to wedge member 33 to translate it from its locked, second transverse position to its unlocked first position relative to post 31 of drop head 23. Once the wedge member is translated in this manner, wedge member 33 is no longer supported by the engagement surfaces 57 on shoulders 59 of post 31, and wedge member 33 falls under influence of gravity or any overlying weight, to rest at the lower position of drop head 23. The slot of member 33 has been configured so that it is wider than shoulders 59 when wedge member 33 is in its unlocked position, and thus wedge member 33 falls below engagement surfaces 57 of shoulders 59 to its lower position. As shown in FIG. 4B, the translational sliding movement of wedge member 33 is confined to approximately 45° relative to adjacent beams 39. Such, manual engagement or hammer strikes applied to wedge member 33 are likewise oriented 45° from the orientation of adjacent ones of beams 39.

Although certain methods of deploying the shoring system have been described herein, and certain operational steps in manipulating drop head 23 have likewise been described, it will be appreciated that variations to deploying the shoring system herein and the associated device 21 are within the spirit and scope of the present invention and that, unless dictated by practical requirements, the order of steps may be varied in utilizing device 21 and its associated shoring system.

Device 21 may be used with beams 39 of any number of configurations and may include tabs 73 or equivalent engagement or supporting structures in any appropriate configuration to removably secure beams 39 relative to device 21 and compression plate 27. Similarly, the number and orientations of attachment points on beam support member 29 may be varied depending on the application.

Figure 5:
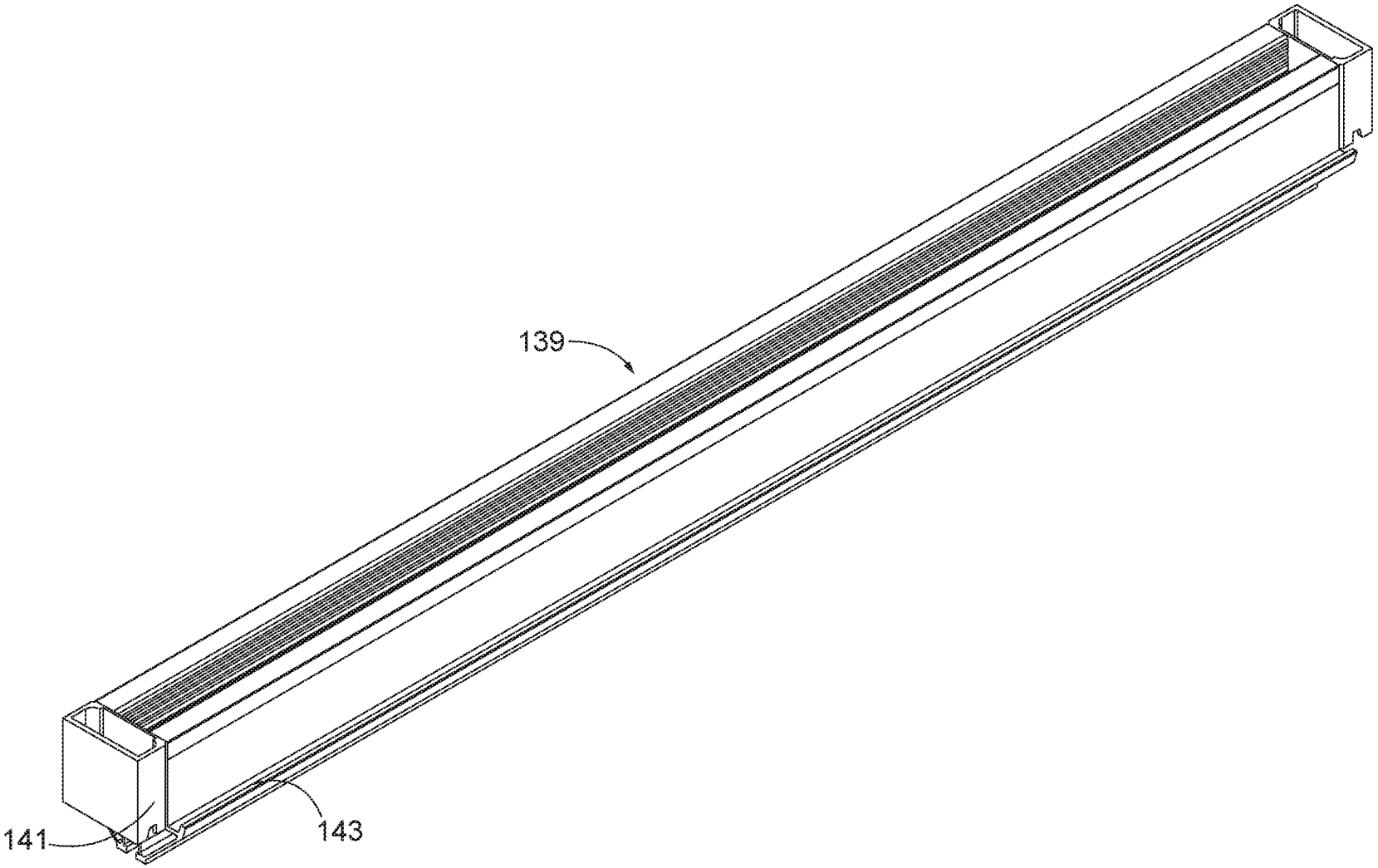
FIGS. 5, 6, and 7 are isometric and cross-sectional views of an exemplary beam useful in systems for shoring and concrete flooring or slabs according to one aspect of the present disclosure.
Figure 6:
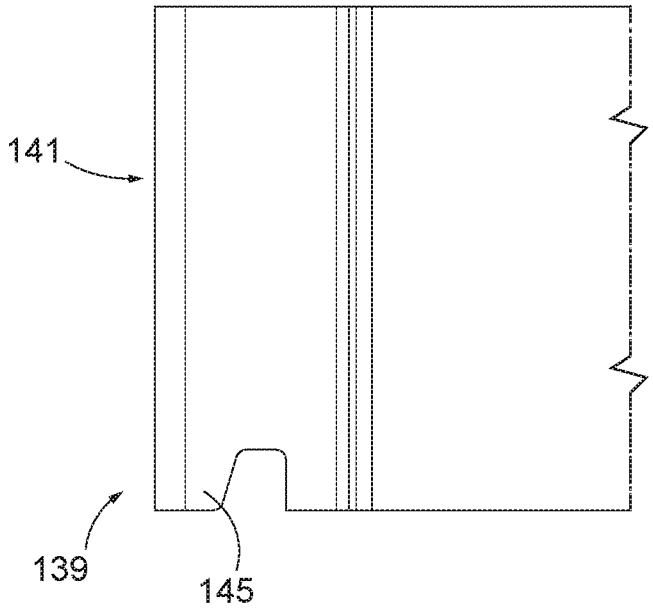
Figure 7:
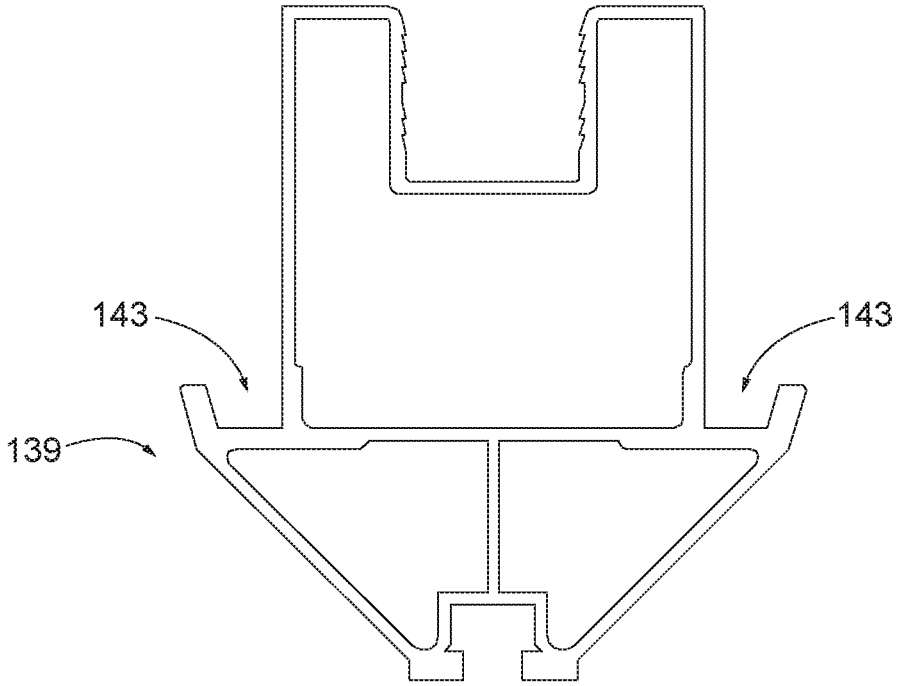
Figure 8:
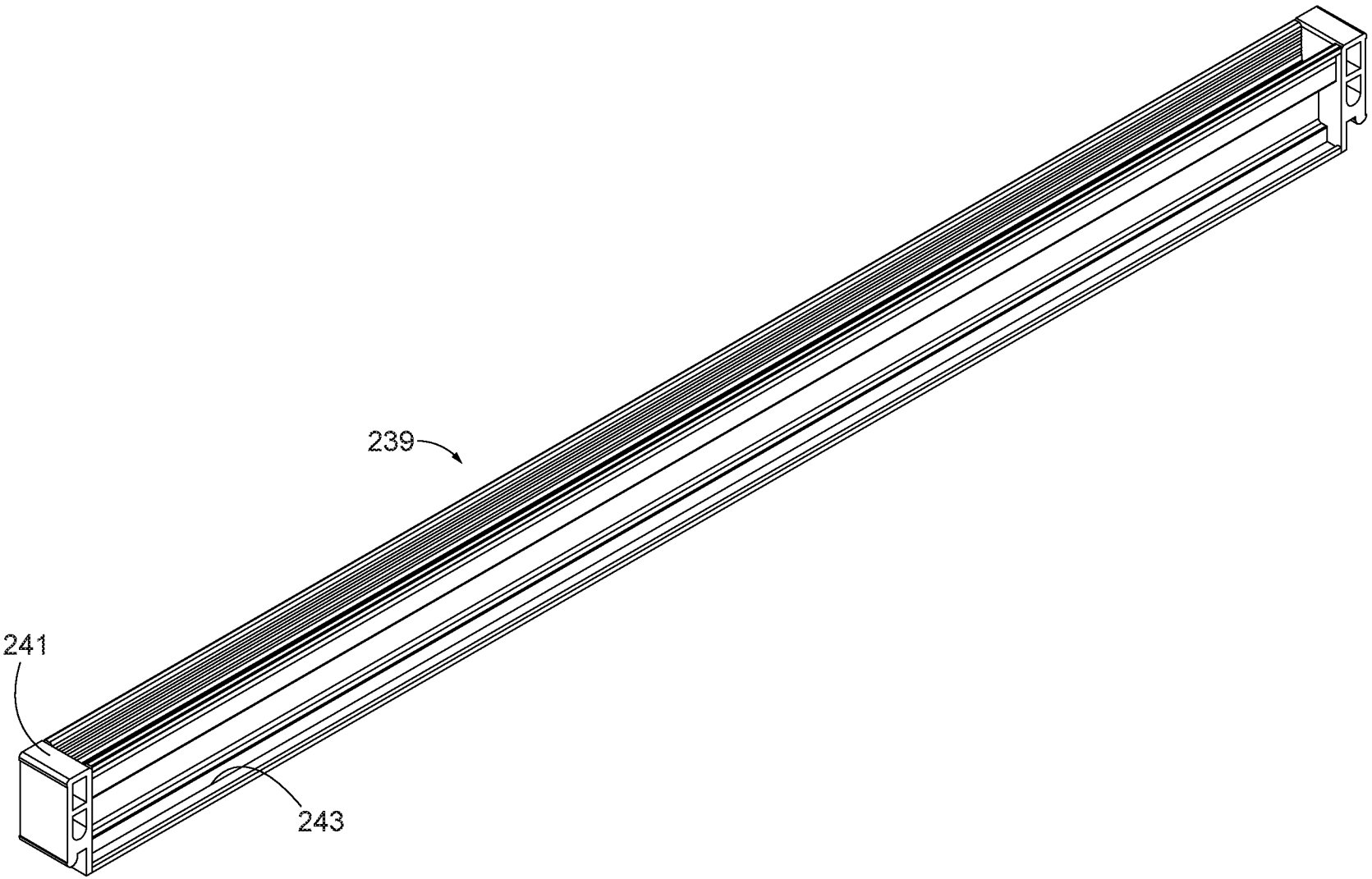
FIGS. 8, 9, and 10 are isometric and cross-sectional views of another embodiment of a beam useable in a system for showing concrete flooring or slabs.
Figure 9:
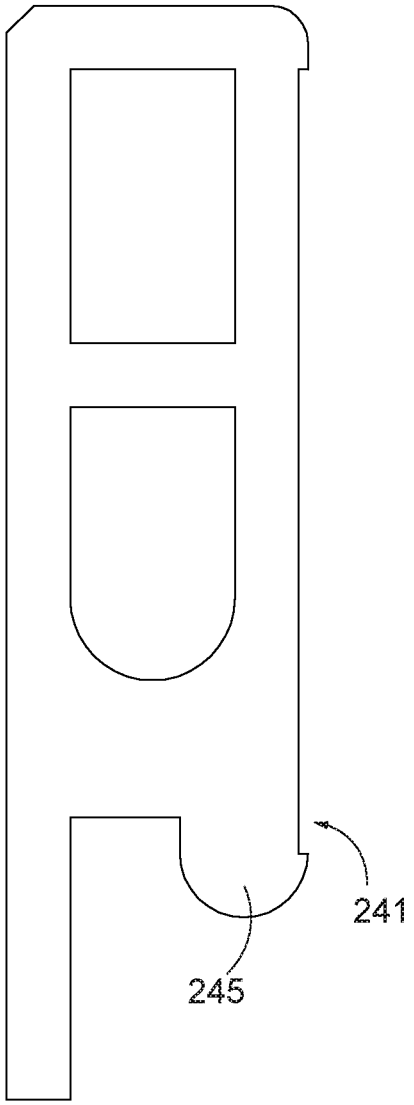
Figure 10:
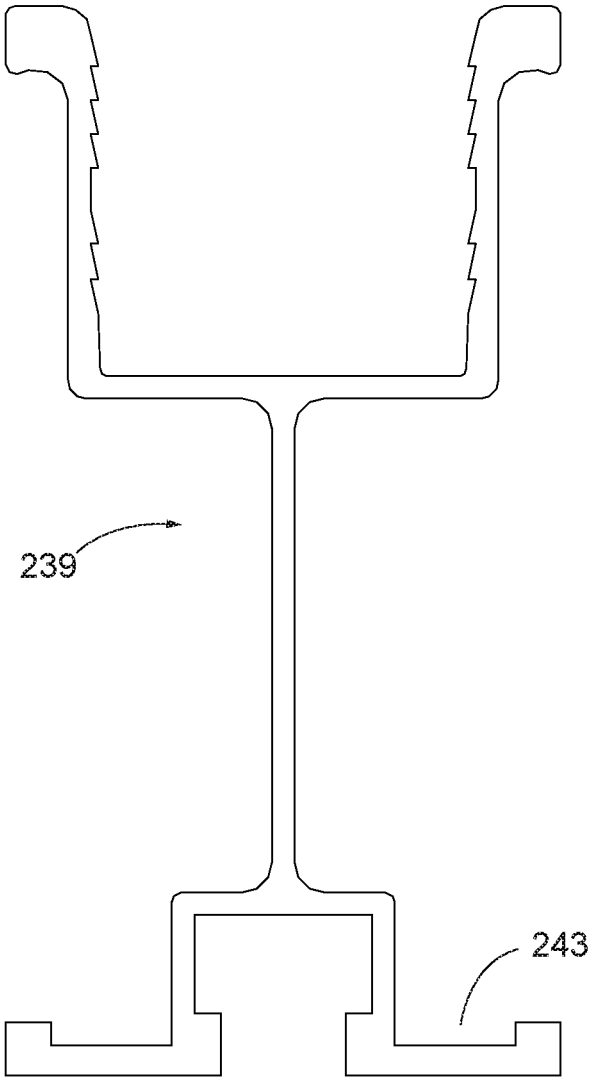
Figure 11:
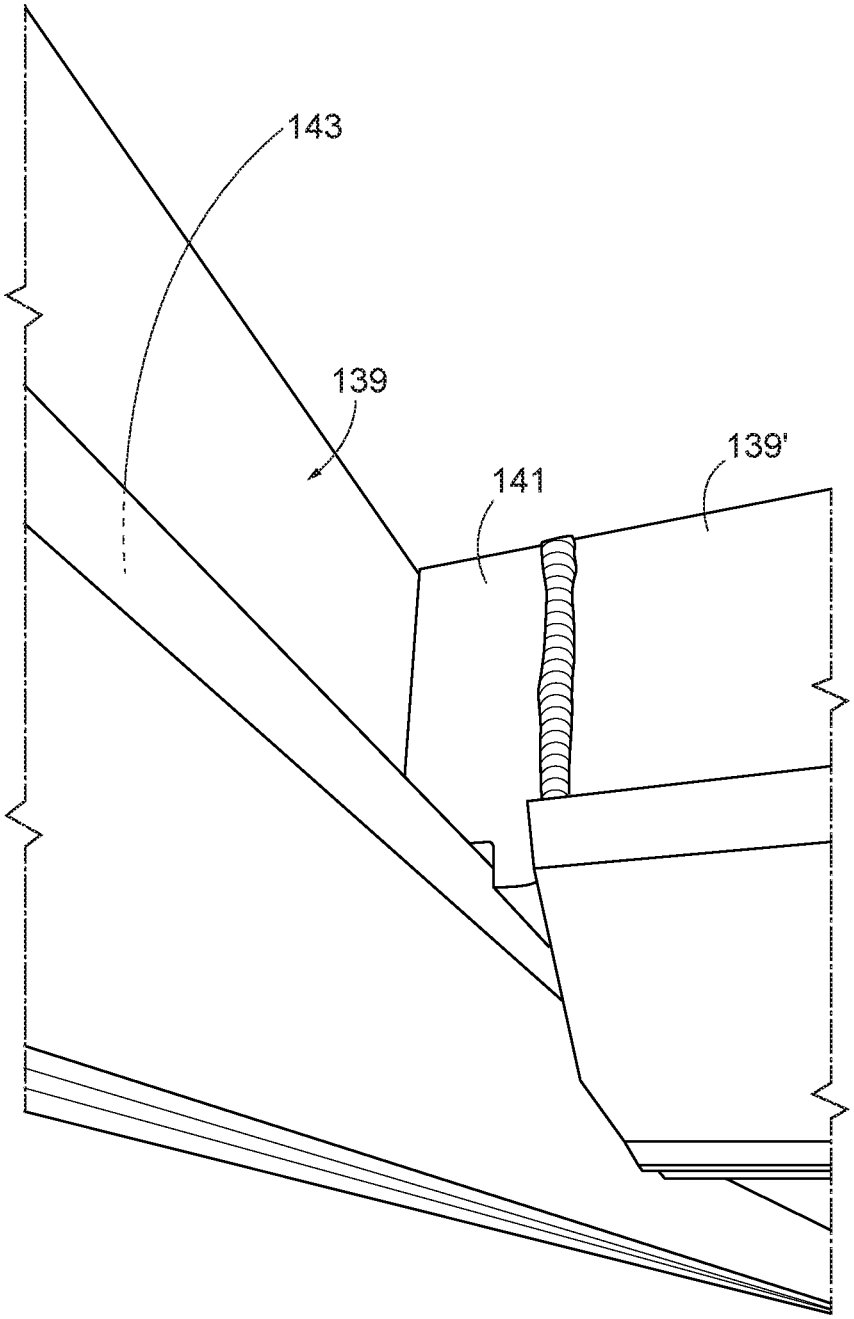
FIG. 11 is an isometric view of two (2) beams according to an aspect of the present disclosure, with one beam being removably received in a portion of another beam.

The shoring system disclosed herein may be used with any number of beam types and configurations. Certain implementations are shown in FIGS. 5-11. Referring to FIGS. 5-7, a beam 139 includes an attachment end 141 having a nose 145 and a slot behind such nose so as to mate with and be engaged with one or more of the tabs of beam support member of drop head 23. In addition, beam 139 may be configured to include to longitudinally extending flanges 143 at the lower end of beam 139, the flanges 143 sized and configured to receive attachment ends from other beams therein, which is shown by way of example in FIG. 11, in which attachment end 141 of another, second beam 139' is shown received in flanges 143.

Still other profiles for beams 39, 139 are possible. For example, referring now to FIGS. 8-10, a beam 239 includes a suitable attachment end 241 with a nose portion as shown in cross-section in FIG. 9 at 245, and a pair of longitudinally extending flanges 243. As in the case of beam 139, beam 239 is adapted to be removably secured at its end 241 not only to tabs 75, but also to other beams 39, including beam 139 at its flange 143. In certain implementations, beam 139 may be considered a primary beam, referred to as a stringer, and extending between drop heads 23, whereas beam 239 may be considered a secondary beam, referred to as a joist, and such secondary beams extending between primary beams. In such implementation, the combination of beams 139 and 239 form a suitable lattice structure for shoring overlying framework or concrete to be poured.

As the invention has been described and shown in detail in the drawings and foregoing description, the same is to be considered as illustrative and not restrictive in nature, it being understood that only the preferred embodiment has been shown and described and that all changes and modifications that come within the spirit of the version of the invention are desired to be protected. Optimum dimensional relationships for parts of the invention, including variations in size, materials, shape, form, function and manner of operation, assembly and use, are deemed readily apparent and obvious to one skilled in the art, and all equivalent relationships to those illustrated in the illustrations and described in the specification are intended to be encompassed by the appended claims.

What is claimed is:

1. A method of shoring or reshoring concrete being laid for a structure, the method comprising:

positioning a plate at a vertical height relative to a horizontal plane so that the plate is capable of supporting load of at least one of a support frame for the concrete or the concrete;

raising a beam support member located below the plate by a longitudinal distance corresponding to the size of temporary beams to be received in the beam support member; and fixing the longitudinal position of the beam support member by imparting horizontal, translational non-rotational movement to a wedge member to translate the wedge member from a first position to a second position relative to the beam support member, the wedge member configured with a slot having a first slot area with a first slot width and a second slot area with a second slot width, the second slot width defined by inwardly extending flanges on opposing walls of the second slot area;

wherein the longitudinal position of the beam support member is fixed when the inwardly extending flanges are disposed above corresponding shoulders of a post supporting the beam support member to define the second position.

2. The method of claim 1, the method further comprising:

removably securing temporary beams to the beam support member;

laying the concrete above the support frame; and dropping the longitudinal position of the beam support member by imparting horizontal, translational non-rotational movement to the wedge member to translate the wedge member from the second position to the first position relative to the beam support member.

3. The method of claim 2, wherein the steps of fixing and dropping the longitudinal position of the beam support further comprises:

confining longitudinal movement of the wedge member relative to the beam support member to a minimum predetermined longitudinal distance below lower edges of the beams to be received on the beam support member; and applying manual force to the wedge member in a plane corresponding to the minimum predetermined distance to translate the wedge member between the two positions to cause the beam support member to be fixed or dropped.

4. The method of claim 3, further comprising:

receiving ends of the beams on the beam support member so that adjacent beams extend outwardly from the beam support member at horizontal planar orientations of 90 degrees relative to each other;

providing opposite ends to the wedge member;

confining the translational, sliding movement of the wedge member to a horizontal planar orientation of 45 degrees relative to adjacent ones of the beams received on the beam support member; and wherein the step of dropping the longitudinal position of the beam support member includes the step of applying manual force to one of the ends of the wedge member at a horizontal planar location of 45 degrees and between adjacent beams or at ribs disposed along the outer perimeter of the wedge.

5. The method of claim 4, wherein the step of applying manual force comprises manually wielding a hammer to strike the wedge member.

* * * * *